US007116541B2

(12) United States Patent
Hertz et al.

(10) Patent No.: US 7,116,541 B2
(45) Date of Patent: Oct. 3, 2006

(54) METHOD AND APPARATUS FOR REDUCING THE SWITCHING NOISE OF AN ELECTROMAGNETIC SWITCHING DEVICE

(75) Inventors: Dirk Hertz, Amberg (DE); Bernhard Streich, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 238 days.

(21) Appl. No.: 10/290,152

(22) Filed: Nov. 8, 2002

(65) Prior Publication Data

US 2003/0164747 A1 Sep. 4, 2003

(30) Foreign Application Priority Data

Nov. 8, 2001 (DE) ..... 101 54 795

(51) Int. Cl.
*H01H 47/28* (2006.01)

(52) U.S. Cl. ..... 361/187; 361/152

(58) Field of Classification Search ..... 361/139, 361/152, 153, 154, 157, 159, 179, 187, 189, 361/190

See application file for complete search history.

(56) References Cited

U.S. PATENT DOCUMENTS 3,961,688 A * 6/1976 Maynard ..... 187/289
5,406,440 A * 4/1995 Wieloch ..... 361/154
5,907,252 A 5/1999 Hayakawa et al. ..... 327/110
6,598,621 B1 * 7/2003 Wygnanski ..... 137/624.18

FOREIGN PATENT DOCUMENTS

| | | |
|---|---|---|
| DE | 35 04 034 A1 | 8/1986 |
| DE | 19609608 | 9/1997 |
| DE | 19983970 | 6/2002 |
| WO | 01/04922 A1 | 12/1999 |

OTHER PUBLICATIONS

German Office Action issued on Aug. 14, 2002.

* cited by examiner

*Primary Examiner*—Ronald Leja
(74) *Attorney, Agent, or Firm*—Harness, Dickey & Pierce, P.L.C.

(57) ABSTRACT

In order to achieve a reduction in the switching noise during operation of an electromagnetic switching device with little complexity, a coil for moving an armature with moving switching contacts is driven in order to make contact at a first minimum value of a supply voltage. The supply voltage is then increased from the first minimum value to a second minimum value as a function of time, such that the moving switching contacts can be moved with the stationary switching contacts into sufficient mutual contact with pressure applied.

20 Claims, 1 Drawing Sheet

METHOD AND APPARATUS FOR REDUCING THE SWITCHING NOISE OF AN ELECTROMAGNETIC SWITCHING DEVICE

The present application hereby claims priority under 35 U.S.C. §119 on German patent publication No. 10154795.1 filed Nov. 8, 2001, the entire contents of which are hereby incorporated herein by reference.

FIELD OF THE INVENTION

The invention generally relates to a method and an apparatus for reducing the switching noise of an electromagnetic switching device.

BACKGROUND OF THE INVENTION

A method and an apparatus are used in areas in which switching noise from an electromagnetic switching device, for example in the case of a control cubicle which is fitted to an elevator cabin and has contactors, is found by the passengers in the elevator cabin to be a disturbing side effect.

SUMMARY OF THE INVENTION

An embodiment of the invention may be based on an object of reducing switching noise during operation of an electromagnetic switching device, with little complexity.

The reduction in the switching noise of an electromagnetic switching device to which voltage is applied, as can be achieved by an embodiment of the invention, may be achieved with regard to the method and with regard to the apparatus in that, in contrast to a conventional way of acting on the coil in a switching device such as this, this coil is not driven with the entire value of the supply voltage, since this would lead to undesirable switching noises. In fact, the supply voltage may be reduced to a value which is just sufficient for movement of the armature. The increase to the total value of the supply voltage may then be used essentially only also to ensure sufficient subsequent mutual application of pressure between the moving and the stationary switching contacts. The time at which the supply voltage is increased from the reduced value to the total value can be determined by use of a simple timer, in particular in the form an RC element.

The method can advantageously be used firstly, in the same way as the apparatus as well, to reduce the switching noise and secondly in a conveyor system, in particular in an elevator system.

BRIEF DESCRIPTION OF THE DRAWINGS

The invention as well as advantageous refinements as claimed in the features of the dependent claims will be explained in more detail in the following text on the basis of the exemplary embodiments which are illustrated schematically in the drawings, in which:

DETAILED DESCRIPTION OF THE PREFERRED EMBODIMENTS

Figure 1:
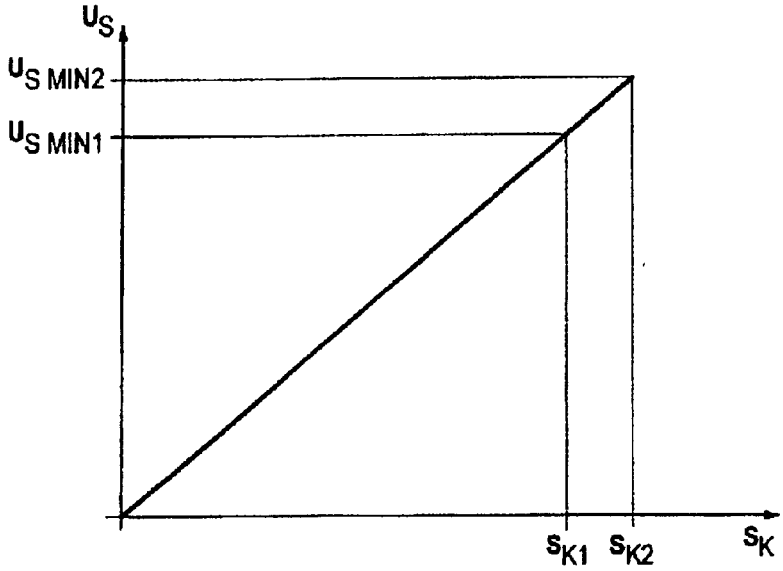
FIG. 1 shows a diagram of the relationship between the first and the second minimum value of the supply voltage for the coil of the electromagnetic switch device, and the extent to which contact is made between the moving and the stationary switching contacts.

FIG. 1 shows schematically by way of example a diagram with a first and a second minimum value $U_{S\ MIN1}$ and $U_{S\ MIN2}$, respectively, of a supply voltage $U_S$, and having a first contact movement $S_{K1}$ and, respectively a second contact movement $S_{K2}$. The first and the second minimum value $U_{S\ MIN1}$ and $U_{S\ MIN2}$, respectively, are in this case plotted on the axis with the supply voltage $U_S$, and the first and the second contact movements $S_{K1}$ and $S_{K2}$, respectively, are plotted on the axis with the contact movement $S_K$.

Figure 2:
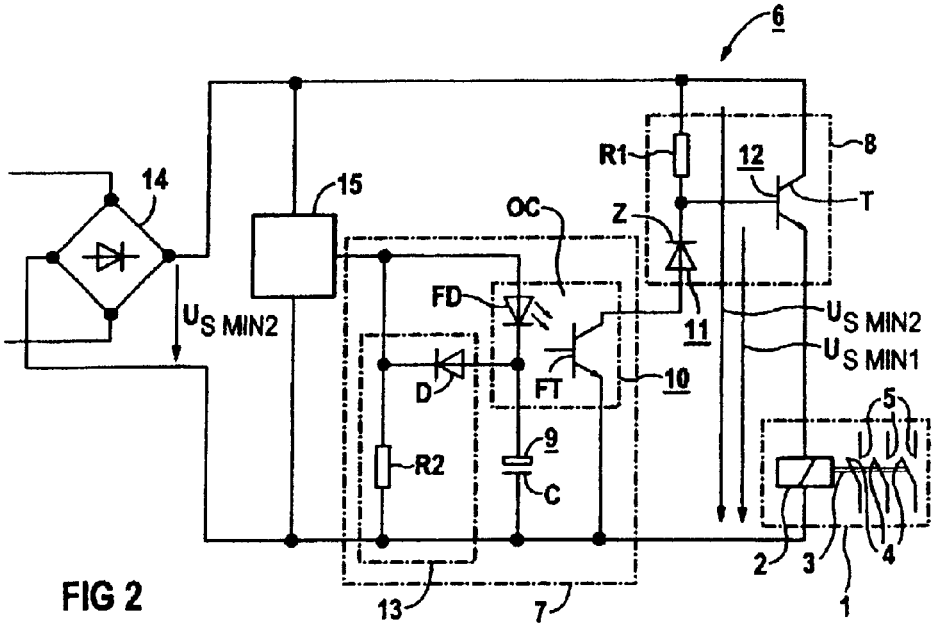
FIG. 2 shows an apparatus for reducing the switching noise of an electromagnetic switch, in the form of a control circuit.

The first minimum value $U_{S\ MIN1}$ and the second minimum value $U_{S\ MIN2}$ of the supply voltage, which are correlated with the first contact movement $S_{K1}$ and with the second contact movement $S_{K2}$, respectively, are major parameters of a method embodiment for reducing the switching noise of an electromagnetic switching device 1. In this case, the electromagnetic switching device 1 has a coil 2, a moving armature 3 as well as moving and stationary switching contacts 4 and 5, as shown in FIG. 2.

The method embodiment results in a reduction in the switching noise in the electromagnetic switching device 1, which is driven with the supply voltage $U_S$, such that first of all, a first minimum value $U_{S\ MIN1}$ of the supply voltage $U_S$ is defined which is sufficient at least for moving the armature 3 with the moving switching contacts 4, and the coil 2 and hence the armature 3 are then driven with the moving switching contacts 4 by the first minimum value $U_{S\ MIN1}$ of the supply voltage $U_S$ at least until contact is made. The supply voltage $U_S$ is then increased from the first minimum value $U_{S\ MIN1}$ to a second minimum value $U_{S\ MIN2}$ in comparison thereto such that the moving switching contacts 4 are moved with the stationary switching contacts 5 into sufficient mutual contact with pressure applied.

The sufficient mutual contact with pressure applied on the basis of the coil 2 being driven with the first minimum value $U_{S\ MIN1}$ and subsequently being driven with a time delay, by the second minimum value $U_{S\ MIN2}$ of the supply voltage $U_S$ can, depending on the type and embodiment variant of the electromagnetic switching device 1, be carried out firstly in the case of rigid switching contacts 4, 5 even after the first contact movement $S_{K1}$. Secondly, in the case of sprung switching contacts 4, 5, it may be carried out in the course of the movement between the first and the second contact movement $S_{K1}$ and $S_{K2}$.

The supply voltage $U_S$ is increased from the first minimum value $U_{S\ MIN1}$ to the second minimum value $U_{S\ MIN2}$ as a function of time, with approximately 0.75 to 0.95 times, in particular 0.9 times, the second minimum value $U_{S\ MIN2}$ being defined for the first minimum value $U_{S\ MIN1}$. The method for reducing the switching noise of an electromagnetic switching device is suitable, inter alia, for use in a conveyor system, in particular in an elevator system.

FIG. 2 shows an apparatus 6 for reducing the switching noise of an electromagnetic switch 1 in the form of a control circuit. The electromagnetic switching device 1 has the moving armature 3 and switching contacts 4, which are moved by this armature 3, as well as stationary switching contacts 5. The switching noise may in this case be caused by the moving switching contacts 4 and the stationary switching contacts 5 bouncing against one another, and/or by the armature 3, which is moved on the basis of the coil 2 through which current flows and which is then energized, and an iron core which corresponds to it.

The apparatus 6 is provided with a drive unit 7 and with a voltage control unit 8. The drive unit 7 is used to drive the voltage control unit 8 as a function of time. The voltage control unit 8 allows the supply voltage $U_S$ for the coil 2 and accordingly for the movement of the armature 3 with the moving switching contacts 4 to be fixed at least at the sufficient first minimum value $U_{S\ MIN1}$. The first minimum value $U_{S\ MIN1}$ of the supply voltage $U_S$ is used for making contact.

Initiated by a time-delayed drive pulse to the drive unit 7, the supply voltage $U_S$ is then increased via the voltage control unit 8 to a second minimum value $U_{S\ MIN2}$, such that the switching contacts 4, 5 can be moved into mutual contact, thus ensuring that sufficient pressure is applied. The first minimum value $U_{S\ MIN1}$ is in this case approximately fixed at 0.75 to 0.95 times, in particular at 0.9 times, the second minimum value $U_{S\ MIN2}$.

The drive unit 7 has a timer 9 in the form of a capacitor C, which is provided in order to determine the time at which the supply voltage $U_S$ is increased from the first minimum value $U_{S\ MIN1}$ to the second minimum value $U_{S\ MIN2}$. A switching element 10 in the form of an optocoupler OC, which is used for driving a voltage limiter 11, is also provided, inter alia, as part of the drive unit 7. The voltage control unit 8 is driven by the drive unit 7 as a function of switching via the switching element 10. The switching element 10 may also be provided in the voltage control unit 8, in an alternative embodiment variant.

The voltage control unit 8 also has the voltage limiter 11 in the form of a zener diode Z, which is provided for limiting the supply voltage $U_S$ to the first minimum value $U_{S\ MIN1}$, for allowing the supply voltage to rise to the second minimum value $U_{S\ MIN2}$ and for driving an actuating element 12, which is arranged in the voltage control unit 8. In an alternative embodiment variant, the voltage limiter 11 may also be arranged in the drive unit 7. The actuating element 12 is in the form of a transistor T and is in this case used for driving the coil 2, whose actuating input is connected to a first resistor R1, which is likewise arranged in the voltage control unit 8. The timer 9 is reset by means of a reset element 13, which is part of the drive unit 7.

The reset element 13 in this case comprises a diode D and a second resistor R2, which is connected in series with it. The second resistor R2, which is arranged in the reset element 13, in this case interacts with the parallel-connected capacitor C, which is used as the timer 9, in the form of an RC element. The optocoupler OC comprises a phototransistor FT and a photodiode FD, which are arranged in series with the capacitor C and with the diode D. The phototransistor FT is connected by one of its zones to the zener diode ZD, which is itself connected in series with the first resistor R1 and with the actuating input of the transistor T. Finally, the transistor T is electrically conductively connected from one of its zones to the coil 2.

The voltage supply for the apparatus 6 is provided, purely by way of example, by a rectifier module 14, which if required may be fed with direct current or alternating current, and/or by an electronic supply module 15, which is used for rectification and for smoothing the supply voltage $U_S$.

The supply voltage $U_S$ is passed via the rectifier module 14 to the electronic supply module 15, which supplies voltage to the photodiode FD in the optocoupler OC, which drives the phototransistor FT by use of a light signal. The phototransistor FT is switched on and its resistance becomes low, so that the zener diode Z has voltage applied to it. Further, in this case, the zener voltage, which corresponds to the first minimum value of the supply voltage $U_{S\ MIN1}$, that is to say approximately 0.9 $U_S$, across this zener diode Z collapses. The coil 2 of the electromagnetic switching device 1 is then driven using the first resistor R1 via the transistor T. In the course of the first contact movement $S_{K1}$, the moving switching contacts 4 make contact with the stationary switching contacts 5.

At the same time that the phototransistor FT is driven, voltage is supplied to the capacitor C via the photodiode FD. In consequence, the latter starts to charge, as a function of time, up to the level of the supply voltage $U_S$ and, on reaching this level, starts to act on the optocoupler OC. The photodiode FD in consequence no longer emits any light signal to the phototransistor FT, as a result of which this now has a high impedance. The zener diode Z is no longer driven, so that the voltage drop amounting to the zener voltage no longer exists. The transistor T is in consequence fully switched on, resulting in the higher, second minimum value of the supply voltage $U_{S\ MIN2}$ being applied to the coil 2. The moving and the stationary switching contacts 4 and 5, respectively, in this case make the sufficient mutual contact $S_{K\ P2}$ with pressure applied. Provided the supply voltage $U_S$ is switched off, the timer 9 is reset by the capacitor C discharging via the diode D to the second resistor R2.

The apparatus 6, which is easy to fit and if appropriate to retrofit, for reducing the switching noise of an electromagnetic switching device 1, for example in the form of a contactor or of a relay, is suitable inter alia for use in a conveyor system, in particular in an elevator system. The level of the respective supply voltage $U_S$ is in this case a measure of the magnitude of the switching noise. Normal values for the supply voltage for DC contactors are approximately between 24 V and 110 V; for AC contactors these values are approximately between 110 V and 230 V. In the case of a DC contactor which is driven at approximately 90% of the original supply voltage $U_S$, which may, for example, be between 85 V and 110 V, the switching-on noise is reduced by about 6 dB. There is thus no need for complex and costly silencing measures.

An embodiment of the invention can be summarized as follows: In order to achieve a reduction in the switching noise during operation of an electromagnetic switching device with little complexity, a coil 2 for moving an armature 3 with moving switching contacts 4 is driven in order to make contact at a first minimum value $U_{S\ MIN1}$ of a supply voltage $U_S$, with the supply voltage $U_S$ being increased from the first minimum value $U_{S\ MIN1}$ to a second minimum value $U_{S\ MIN2}$ as a function of time such that the moving switching contacts 4 can be moved with the stationary switching contacts 5 into sufficient mutual contact with pressure applied.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for reducing the switching noise of an electromagnetic switching device including a coil drivable by a supply voltage, and an armature adapted to move moving switching contacts into contact with stationary switching contacts, the method comprising:

defining a first minimum value of the supply voltage, sufficient for at least moving the armature with the moving switching contacts;

using a drive unit to drive the coil, and hence the armature, with the moving switching contacts by the first minimum value of the supply voltage, at least until contact is made; and increasing, as a function of time, the supply voltage from the first minimum value to a second minimum value, sufficient to move the switching contacts into sufficient mutual contact with the stationary switching contacts with pressure applied;

wherein the drive unit includes a switching element for driving a voltage limiter; and wherein the switching element is an optocoupler.

2. A conveyor system adapted to perform the method of claim 1.

3. An elevator system, adapted to perform the method of claim 1.

4. An apparatus for reducing the switching noise of an electromagnetic switching device including a coil drivable by a supply voltage, and an armature adapted to move moving switching contacts into contact with stationary switching contacts, comprising:

a voltage control unit, adapted to fix the supply voltage, for moving the armature with the moving switching contacts, at least at a sufficient first minimum value; and a drive unit, adapted to drive the coil with the first minimum value of the supply voltage at least until contact is made, wherein the supply voltage is then adapted to be increased via the voltage control unit, as a function of time, from the first minimum value to a second minimum value, sufficient to move the moving switching contacts into sufficient mutual contact wherein the drive unit includes a switching element for driving a voltage limiter; and wherein the switching element is an optocoupler. with the stationary switching contacts with pressure applied;

5. The apparatus as claimed in claim 4, wherein the drive unit includes a timer, adapted to determine a time for increasing the supply voltage from the first minimum value to the second minimum value.

6. The apparatus as claimed in claim 5, wherein the timer is an RC element.

7. The apparatus as claimed in claim 4, wherein the voltage control unit includes a switching element.

8. The apparatus as claimed in claim 4, wherein the drive unit includes the voltage limiter for limiting the supply voltage to the first minimum value, for allowing the supply voltage to rise to the second minimum value and for driving an actuating element, arranged in the voltage control unit.

9. The apparatus as claimed in claim 8, wherein the actuating element is a part of the voltage control unit for driving the coil.

10. The apparatus as claimed in claim 8, wherein the drive unit includes a reset element for resetting a timer when the supply voltage is switched off.

11. The apparatus as claimed in claim 4, wherein the voltage limiter is a part of the voltage control unit.

12. The apparatus as claimed in claim 4, wherein the drive unit includes a reset element for resetting a timer when the supply voltage is switched off.

13. The apparatus as claimed in claim 4, wherein the switching relationship between the drive unit and the voltage control unit is formed via a switching element.

14. A conveyor system including the apparatus of claim 4.

15. An elevator system including the apparatus of claim 4.

16. An apparatus for reducing the switching noise of an electromagnetic switching device including a coil drivable by a supply voltage, and an armature adapted to move moving switching contacts into contact with stationary switching contacts, comprising:

voltage control means for fixing the supply voltage to at least at a sufficient first minimum value, sufficient to move the armature with the moving switching contacts; and driving means for driving the coil with the first minimum value of the supply voltage at least until contact is made, wherein the supply voltage is then increased, as a function of time, via the voltage control means from the first minimum value to a second minimum value, sufficient to move the moving switching contacts into sufficient mutual contact with the stationary switching contacts with pressure applied;

wherein the driving means includes a switching element for driving a voltage limiter; and wherein the switching element is an optocoupler.

17. The apparatus as claimed in claim 16, wherein the driving means includes a timer, adapted to determine a time for increasing the supply voltage from the first minimum value to the second minimum value.

18. The apparatus as claimed in claim 16, wherein the voltage control means includes a switching element.

19. A conveyor system including the apparatus of claim 16.

20. An elevator system including the apparatus of claim 16.

* * * * *